US007296546B2

(12) United States Patent
Schön et al.

(10) Patent No.: US 7,296,546 B2
(45) Date of Patent: Nov. 20, 2007

(54) DEVICE FOR THE VARIABLE ACTUATION OF THE GAS EXCHANGE VALVES OF INTERNAL COMBUSTION ENGINES, AND METHOD FOR OPERATING ONE SUCH DEVICE

(75) Inventors: Helmut Schön, Frastanz (AT); Kai-Uwe Keller, Kreuzlingen (CH); Peter Kuhn, Weinheim (DE); Gordon Köhne, Bregenz (AT); Frank Obrist, Dornbirn (AT); Christian Busch, Feldkirch (AT)

(73) Assignee: Thyssenkrupp Automotive AG, Bochum (DE)

( * ) Notice: Subject to any disclaimer, the term of this patent is extended or adjusted under 35 U.S.C. 154(b) by 138 days.

(21) Appl. No.: 10/551,540

(22) PCT Filed: Mar. 17, 2004

(86) PCT No.: PCT/EP2004/002743

§ 371 (c)(1),
(2), (4) Date: Sep. 14, 2005

(87) PCT Pub. No.: WO2004/085804

PCT Pub. Date: Oct. 7, 2004

(65) Prior Publication Data

US 2006/0260574 A1 Nov. 23, 2006

(30) Foreign Application Priority Data

Mar. 24, 2003 (DE) ..... 103 12 959

(51) Int. Cl.
*F01L 1/34* (2006.01)

(52) U.S. Cl. ..... 123/90.16; 123/90.2; 123/90.15; 123/90.17; 123/90.43

(58) Field of Classification Search ..... 123/90.16
See application file for complete search history.

(56) References Cited

U.S. PATENT DOCUMENTS 4,572,118 A * 2/1986 Baguena ..... 123/90.16

(Continued)

*Primary Examiner*—Thomas Denion
*Assistant Examiner*—Kyle M. Riddle
(74) *Attorney, Agent, or Firm*—Max Fogiel

(57) ABSTRACT

The invention relates to a device for the variable actuation of gas exchange valves for internal combustion engines, wherein at least one cam (2) pertaining to a camshaft (1) mounted in a housing rotates according to the engine speed. The cam (2) first drives an intermediate member (4) which performs a clear oscillating, rotary movement and has a rotational axis (7) that can be displaced in the housing parallel to itself along a curve of displacement (8), said intermediate member comprising a control cam (5) having a lifting region (5*b*) and actuating an output member (11) that, in turn, actuates at least one valve (13). The aim of the invention is to enable one such device to be reliably controlled. To this end, the control cam (5) has a catch region (5*a*), and the intermediate member (4) is mounted on a bearing having an axis which corresponds to the rotational axis (7), said bearing being arranged in such a way that it is guided in a forced manner and can be displaced parallel to the curve of displacement (8, 28, 35), by means of an articulation (16, 24, 26) connected to the cylinder head or the housing or by a slide (34) that is guided in the housing in a positively locking manner. The invention also relates to a method for operating an internal combustion engine comprising a plurality of cylinders using at least one of the inventive devices.

22 Claims, 7 Drawing Sheets

U.S. PATENT DOCUMENTS 6,481,399 B1 * 11/2002 Morrn ..... 123/90.16
6,792,903 B2 * 9/2004 Morrn ..... 123/90.16
6,886,512 B2 * 5/2005 Naumann ..... 123/90.39
6,907,852 B2 * 6/2005 Schleusener et al. .... 123/90.16
7,111,600 B2 * 9/2006 Naumann ..... 123/90.39

* cited by examiner

DEVICE FOR THE VARIABLE ACTUATION OF THE GAS EXCHANGE VALVES OF INTERNAL COMBUSTION ENGINES, AND METHOD FOR OPERATING ONE SUCH DEVICE

BACKGROUND OF THE INVENTION

Such devices are used to control gas exchange valves in such a way, that it becomes possible to operate reciprocating engines without the throttle valve that would otherwise be necessary.

Such a device is disclosed in DE 101 23 186 A1, for example. In this device, a rotating cam first drives a connecting link, which executes a pure oscillating rotary motion and carries a radial cam which is composed of a rest area and a lift area. The radial cam transfers the lifting curve necessary for actuation of the valve to the roller of a driven element similar to a cam follower which in turn actuates the valve. The desired different valve lifting curves are produced by the fact that the center of rotation of the connecting link is displaced on an arc-shaped path which is concentric to the roller of the driven element when it is in the position that it assumes when the valve is closed. The center of rotation is formed by a roller which is provided on the connecting link and which is supported in a non-positive manner on an arc-shaped track in the housing; this track is also concentric to the roller of the driven element, that is, it forms an equidistant to the path of the center of rotation and is designated as the courses. In addition, the roller on the connecting link is supported against a cam disk, whose angular position determines the position of the center of rotation on its arc-shaped path. However, the prior art device is encumbered by some disadvantages.

First, the roller on the connecting link only lies against the courses when the gas forces and inertial forces of the valve train are correspondingly oriented and the roller is actually supported on the courses. If this is not the case, which can happen when an overspeed occurs, for example, then the non-positive connection is lost and a liftoff occurs, which causes noise and even damage when it comes back down. In addition, it is relatively difficult to machine the coulisses, which are segments of an inside cylinder and cannot be machined in a continuous manner, and the commonly used housing materials are insufficiently hard for the contact between the roller and the courses. There is a disadvantage concerning mounting, which is that the valve gear housing cannot be set on the cylinder head in completely premounted form.

Other devices of this type have been disclosed in which the center of rotation of the connecting link driven by the cam is supposed to be adjusted on a circular path (OS 195 32 334 A1; EP 0 717 174 A1; DE 101 64 493 A1). However, the previous publications do not contain any teaching about how to construct the devices to realize such adjustment.

It is a common disadvantage of all devices that, due to manufacturing tolerances, as the valve strokes of the individual cylinders are reduced further for the purpose of controlling the load, the differences between the valve strokes of the individual cylinders become greater.

It is an object of the invention to create a device, which avoids the disadvantages of the prior art and allows secure control.

SUMMARY OF THE INVENTION

Pursuant to the invention, the centers of rotation of the connecting links driven by the cams are restricted to the adjustment curve, that is they are guided by a positive fit. This ensures that the center of rotation of a connecting link cannot leave the adjustment curve, avoiding noise and damage which would result from it doing so. The design preferably realizes this feature by the fact that one or more connecting links are mounted on a cylindrical bolt on whose axis the centers of rotation lie, and that the axis of the bolt is restricted to the adjustment curve. If the active area on the driven element to which the radial cam of the connecting link transfers its motion is a circular cylinder, that is if it is formed by a roller, for example, it is possible to assume that the adjustment curve is arc-shaped and that its center coincides with the center of the circular cylindrical active area, that is, the roller.

Such an adjustment curve is realized according to another inventive proposal by pendulum supports, each of whose first joints are connected with the cylinder head or the control housing, and each of whose second joints are connected with the bolt. In this arrangement, the axis common to the joints on the cylinder head side coincides with the axis of the mentioned cylindrical active areas on the driven element, and that of the bolt-side joints coincides with the axis of the bolt. This has the result that the force flows exclusively through flat contact areas on the shortest paths from the bolt to the cylinder head or the control housing. In particular, no forces are transferred through Hertzian stress on the cylinder head or the control housing.

If the driven elements of neighboring valves, whether they should be similar to a cam follower or straight, should have insufficient space between them for the above solution, then it is also possible, according to the inventive solution, for the bolt or its axis to be restricted to the adjustment curve with four-bar linkages formed from pendulum supports. The adjustment curve which can be realized in this way approximates the shape of an arc and matches it exactly at the design point, if the system lines meet in the center of this arc. The deviations outside the design point are taken up by hydraulic play compensation elements which are provided on the driven elements which are similar to a cam follower or also straight.

A third embodiment of the inventive device involves guiding the bolt by a slide which is linearly adjustable in the control housing. This embodiment makes it possible to meet other, special space requirements. Relatively large contact areas are realized between the slide and the control housing, so that the strength properties of the housing material suffice in any case. The resulting adjustment curve is a straight line whose deviations from the shape of an arc are also taken up by play compensation elements.

In all three embodiments, the position of the bolt or its axis on the respective adjustment curve is preferably determined by direct or indirect contact against one or more cam disks, which are put on one or more adjusting shafts that are connected in a torsionally rigid manner. The adjusting shaft or the adjusting axle can in turn be rotated or displaced through a suitable transmission or a connecting element by means of adjustment, for example an adjusting motor. Of course the adjustment can also be accomplished by hydraulic elements. If the bolt is guided by a linearly adjustable slide, the adjustment can also be accomplished directly from the adjusting motor through a spindle which has a movement thread.

All embodiments also share the fact that the connecting links or their cam rollers have to be held in contact with the cams by special springs. This is immediately seen from the situation at zero lift, when there is cylinder cutout.

A variant of the three embodiments which is especially advantageous with regard to space and part variety consists of simultaneously making the bolt on which the connecting links are mounted in the form of an adjusting shaft by providing it with cam disks, mounting it so that it can rotate in the pendulum supports, the four-bar linkage, or the slide, and rotating it by means of adjustment, for example an adjusting motor, according to the desired valve lifting curve. In this variant, in the valve gear housing it is necessary to provide sliding blocks for the cam disks which are made of a material of increased hardness. Since, as a rule, the adjusting motor is arranged so that it is fixed to the housing, but the bolt or the control shaft is displaced parallel to itself during the adjustment movement, it is necessary to arrange a connection element between the two which allows this displacement. Depending on space conditions, this can be an articulated shaft, a Schmidt coupling, an Oldham coupling, or also a toothed gear or a chain gear. If it is hydraulically actuated, a lever mechanism is another option.

The inventive device, including an adjusting motor or an adjusting device, can be separately provided for every valve of an engine, so that any combination of valve strokes or opening angles of the individual valves of an engine is possible, including the turning off of individual cylinders. However, as a rule common adjustment of several valves is provided. This applies especially for intake and exhaust valves of a cylinder in multiple-valve engines. For example, two intake valves can be actuated by a cam through a connecting link which has a radial cam for each valve. Since only one connecting link and only one bolt is present, both valves are adjusted together and in the same way. However, the inventive device also allows the common connecting link to have two different radial cams on it with the result of two different lifting curves on the two valves, despite the fact that they are adjusted together. This variant makes it possible, especially in the lowest load range, to open only one of the two valves. The special advantage of this possibility is that in the lowest load range it is possible to expose only very small cross sections which can be more precisely observed, if they are only exposed by one valve. In addition, opening only one of the intake valves makes it possible to produce swirl in the cylinder charge. The inventive device further expands the possibilities for producing different valve lifting curves for two intake or exhaust valves of a cylinder by the fact that two different cams and two connecting links are used with different radial cams. Nevertheless, the two valves can be adjusted together, since the two connecting links can be mounted on a common bolt.

It is also possible to adjust the connecting links of a larger number of parallel valves together by an adjusting motor or mechanism, especially when it is mounted on a common bolt.

Since it is of great significance for the acceptance of variable valve actuation, that is also the inventive device, to keep the adjusting power small, and since it is higher when the device or its slip joints and links are in loaded condition than when they are in the load-free state that is present to a great extent when the valve is closed, the inventive device provides adjustment essentially during the common rest phases of all valves to be adjusted in common. These rest phases are derived from the signals of [sensors on] the crankshaft and the camshaft, and become shorter and shorter the more valves are adjusted together. Thus, the number of valves adjusted together is limited.

The common adjustment of the intake and exhaust valves only of one cylinder in every case produces long rest phases that are "friendly" to adjustment. However, it also makes possible individual load control of the individual cylinders with an inventive adjustment strategy that involves controlling the torques of the individual cylinders for each load state of the entire engine. This is essential for engine smoothness, especially in the lower load range, since manufacturing tolerances mean that the valve strokes do not sufficiently coincide. The signals necessary for this adjustment strategy are also supplied by the rotational angle sensor of the crankshaft and assigned to the individual cylinders by the rotational angle sensor of the camshaft.

The largely independent adjustment of the intake and exhaust valves offers the possibility of turning off selected valves by means of a continuous adjusting shaft, that is no longer opening them or at least adjusting a smaller valve stroke. To accomplish this, sections of the described cam disks of the adjusting shaft are formed as a rest for the valves that are not turned off. The rest area is a contour which is formed from an arc that is concentric to the center of rotation of the adjusting shaft. Twisting the adjusting shaft does not change the valve stroke of the units controlled by the cam disks with rest within the range of action of the rest, while the valve stroke of the units controlled by the cam disks without rest is changed. This change can be carried out until the valve is held completely closed. If all intake valves or/and the exhaust valves of the same cylinder are triggered in this way, the change in load is turned off for selected cylinders. Of course the same function is achieved by using a straight guided draw key with a corresponding cam contour. The rest area is then a contour which is formed from a line parallel to the sliding direction of the draw key.

The inventive solution has advantageously found an exact, low-wear adjustment device for gas exchange valves, which also works with great accuracy.

BRIEF DESCRIPTION OF THE DRAWINGS

The invention is explained in greater detail below by means of drawings of a few examples. In the associated drawings.

DETAILED DESCRIPTION OF THE INVENTION

Figure 1:
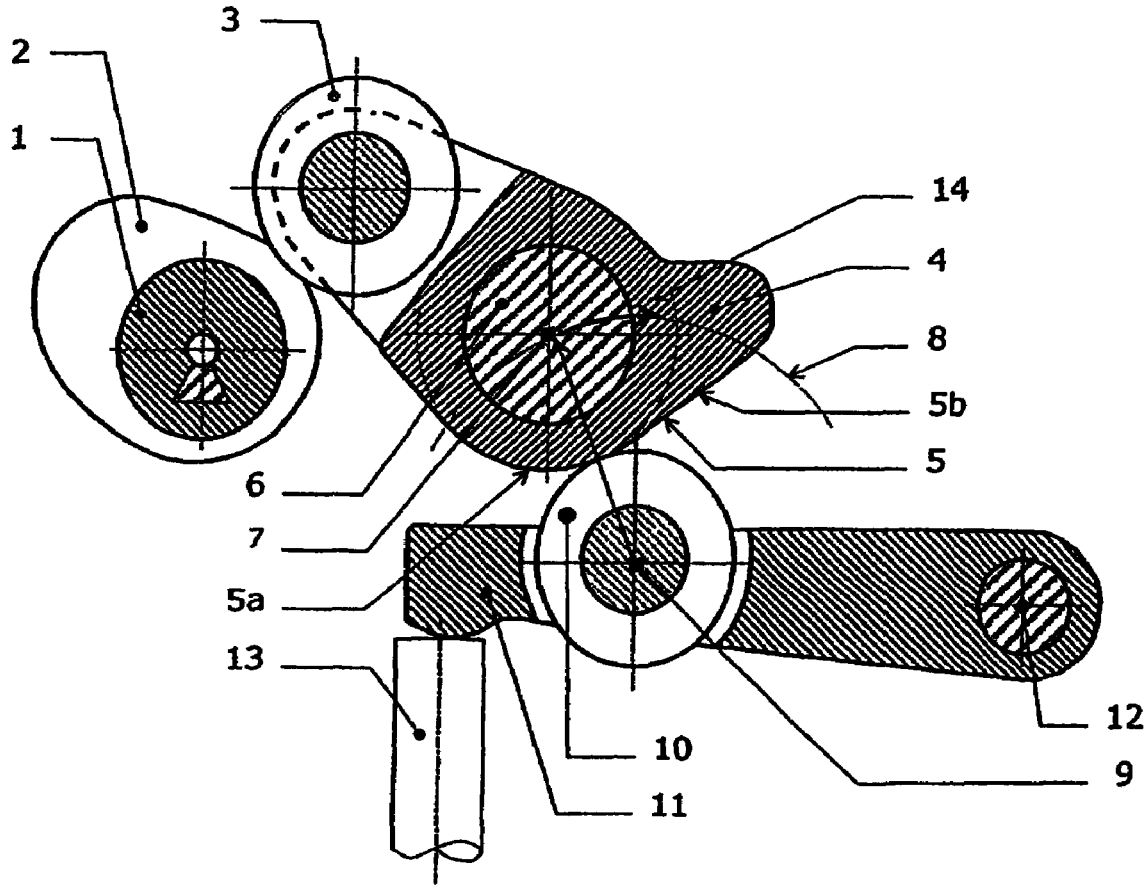
FIG. 1 shows the moving parts of the inventive device which are involved in the flow of force from the camshaft to the valve.

FIG. 1 shows a camshaft 1, which has a cam 2. The cam moves roller 3 at the end of connecting link 4. Connecting link 4 has a radial cam 5 which is composed of a rest area 5*a* and a lift area 5*b*. Connecting link 4 is mounted on a bolt 6 whose axis 7 is guided on an arc-shaped adjustment curve 8. The center of the arc-shaped adjustment curve 8 is on the axis 9 of the roller 10 of the driven element 11 which is supported through a joint 12 in a housing (not shown) and actuates valve 13. It can clearly be seen that adjustment of axis 7 on the adjustment curve 8 in the direction of arrow 14 has the consequence of reducing the opening angle and stroke of valve 13.

Figure 2:
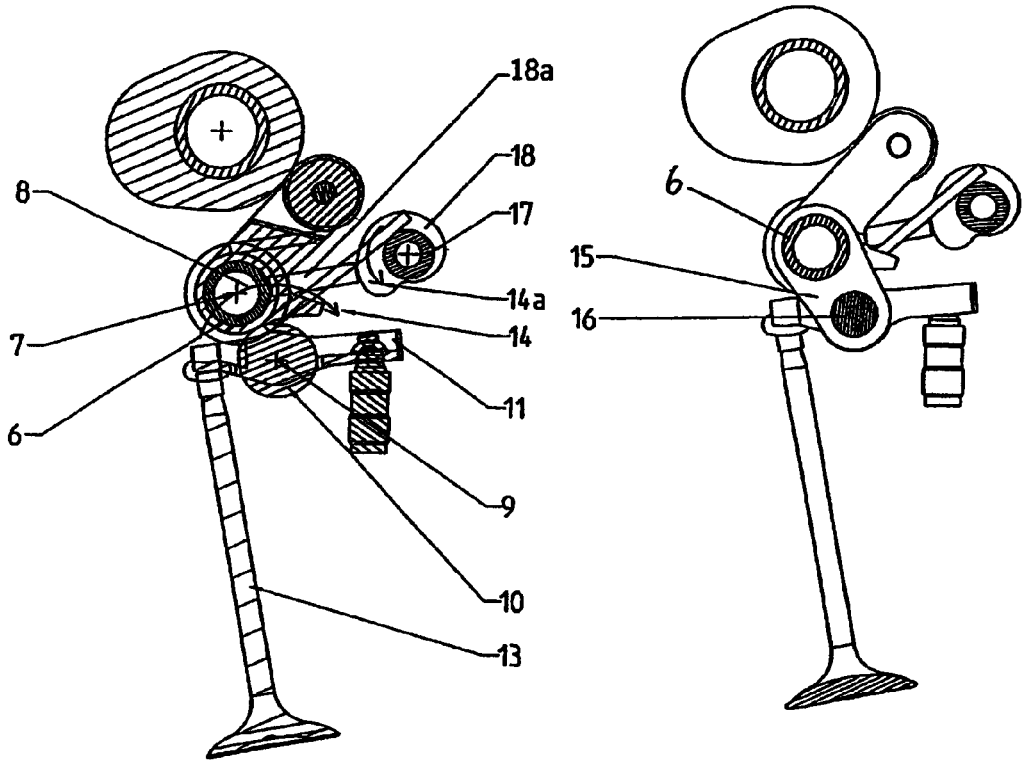
FIG. 2 shows a cross-section using the parts shown in FIG. 1 with a pendulum support and adjusting shaft.

FIG. 2 shows an embodiment in which the bolt 6 or its axis 7 is guided on the arc-shaped adjustment curve 8 by positive connection to a pendulum support 15. Cylinder head-side joint 16 of pendulum support 15 or its axis coincides with the axis 9 of roller 10 of driven element 11. Adjusting shaft 17 holds cam disks 18, which determine, through tappet 18*a*, the position of bolt 6 or its axis 7 on the adjustment curve 8. Axis 7 is adjusted on adjustment curve 8, as shown by the direction arrow 14, by rotating cam disk 18 or adjusting shaft 17 in the direction arrow 14*a*. The described adjustment movement has the consequence of reducing the stroke and opening angle of valve 13.

Figure 3:
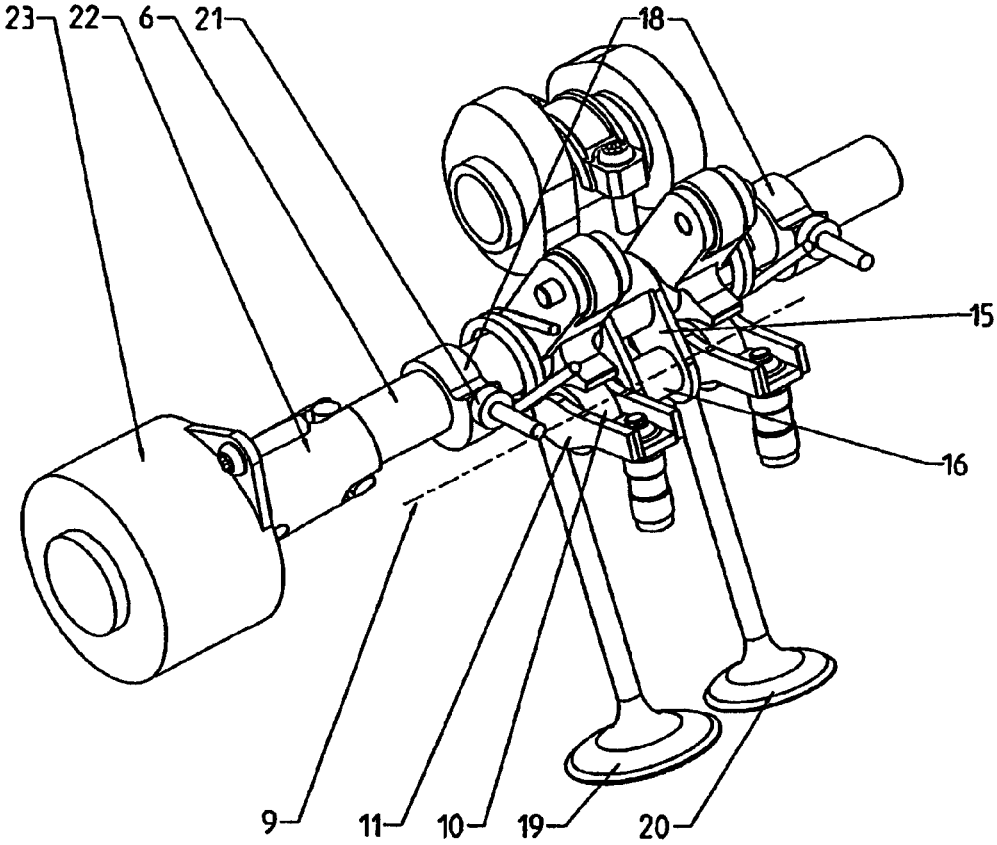
FIG. 3 is a perspective view of the inventive device with a pendulum support and the bolt serving as adjusting shaft.

FIG. 3 is a perspective illustration of the inventive device with a pendulum support 15 for intake valve 19 and exhaust valve 20 of a cylinder, singled out from a series of cylinders or valves. It is easy to see the cylinder head-side joint 16 of pendulum support 15, whose axis coincides with the axis 9 of roller 10 of driven elements 11, so that bolt 6 is restricted to an arc-shaped adjustment curve. In distinction to the embodiment shown in FIG. 2, here bolt 6 simultaneously assumes the function of the inventive device's adjusting shaft. It holds cam disks 18, which are supported on hardened sliding blocks 21 in the housing, and it can rotate in the pendulum support. Bolt 6 is connected, through a suitable connection element, with the adjusting motor 23 that is fixed with respect to the housing. In this example, the connection element is an articulated shaft 22. This embodiment presents substantial advantages with respect to part variety, but also space in the area where the actual valve actuation occurs. Since connection elements other than articulated shafts can be used, such as Schmidt couplings, Oldham couplings, toothed gears, or a chain gears, this provides a certain flexibility for placement of the adjusting motor 23.

Figure 4:
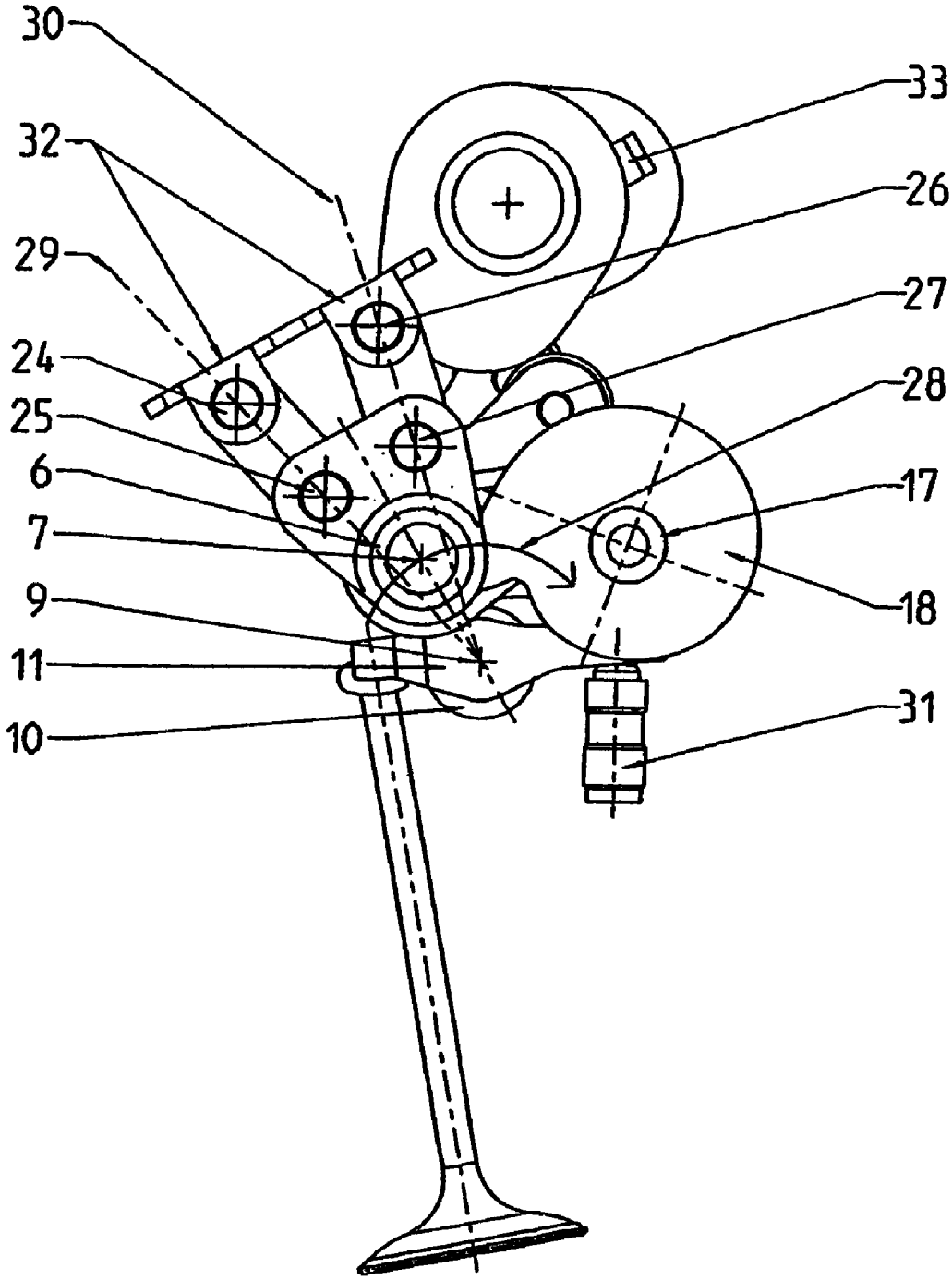
FIG. 4 is a cross-section through the device with a four-bar linkage and adjusting shaft.

FIG. 4 shows a cross section of another embodiment of the invention for a valve or cylinder arrangement such as that shown in FIG. 3. Here bolt 6 is restricted by four-bar linkages (24, 25, 26, 27) to an adjustment curve 28 which approximates the shape of an arc. If system lines 29 and 30 meet on axis 9 of roller 10 of driven element 11, then the bolt's instantaneous center of rotation even lies precisely there. Deviations in the other area must be taken up by the play compensation element 31. Here again bolt 6 could assume the function of the adjusting shaft, as shown in FIG. 3. However, it is also possible to use a separate adjusting shaft 17 with cam disks 18, as shown. The embodiment shown is especially suitable for preassembly of valves along with springs, levers, and play compensation elements in the cylinder head as a lower part, and complete preassembly of all other parts in the valve gear housing as a top part. In this regard it is advantageous that bearing blocks 32 for joints 24 and 26 can be bolted in the same plane as the cover 33 of the camshaft bearings.

Figure 5:
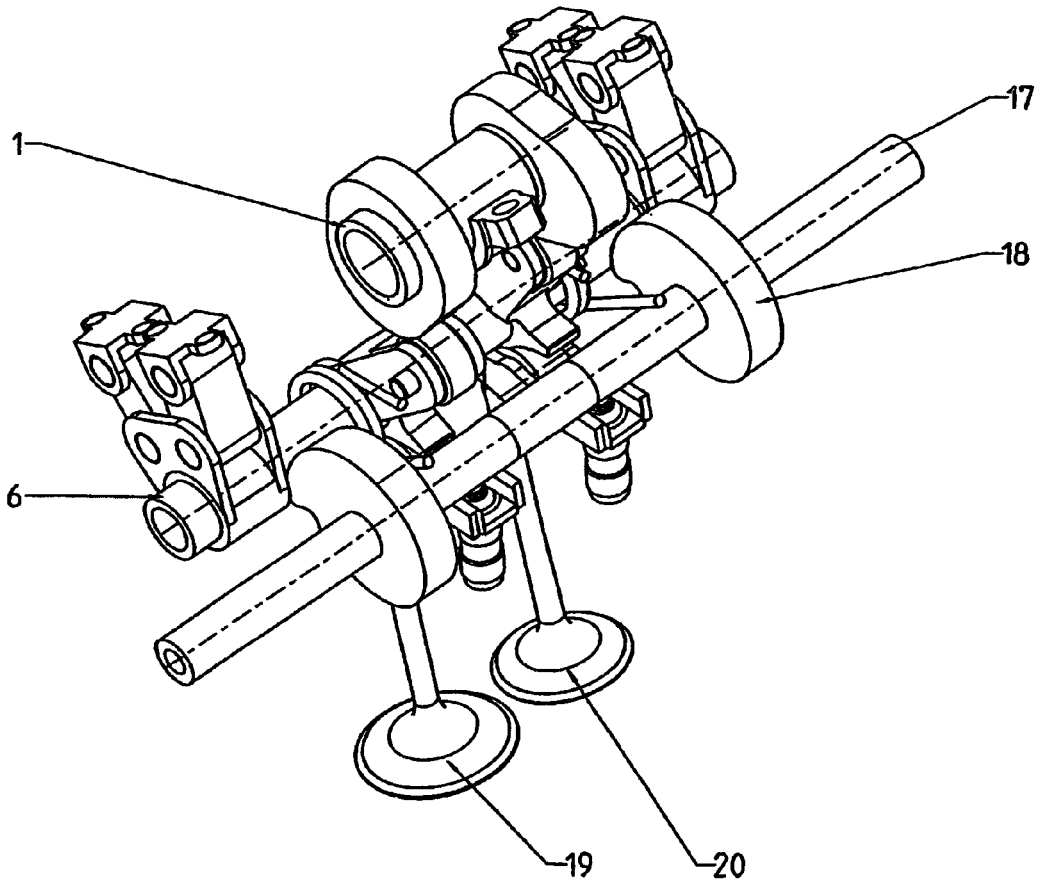
FIG. 5 is a perspective view of the device shown in FIG. 4.

FIG. 5 is a perspective illustration of the device shown in FIG. 4. It is easier to see intake valve 19 and exhaust valve 20 of the cylinder that is singled out, as well as the direct actuation of bolt 6 by cam disks 18. It can clearly be seen that not only bolt 6 and camshaft 1, but also adjusting shaft 17 can be preassembled in the top part of the housing, the valve gear housing.

Figure 6:
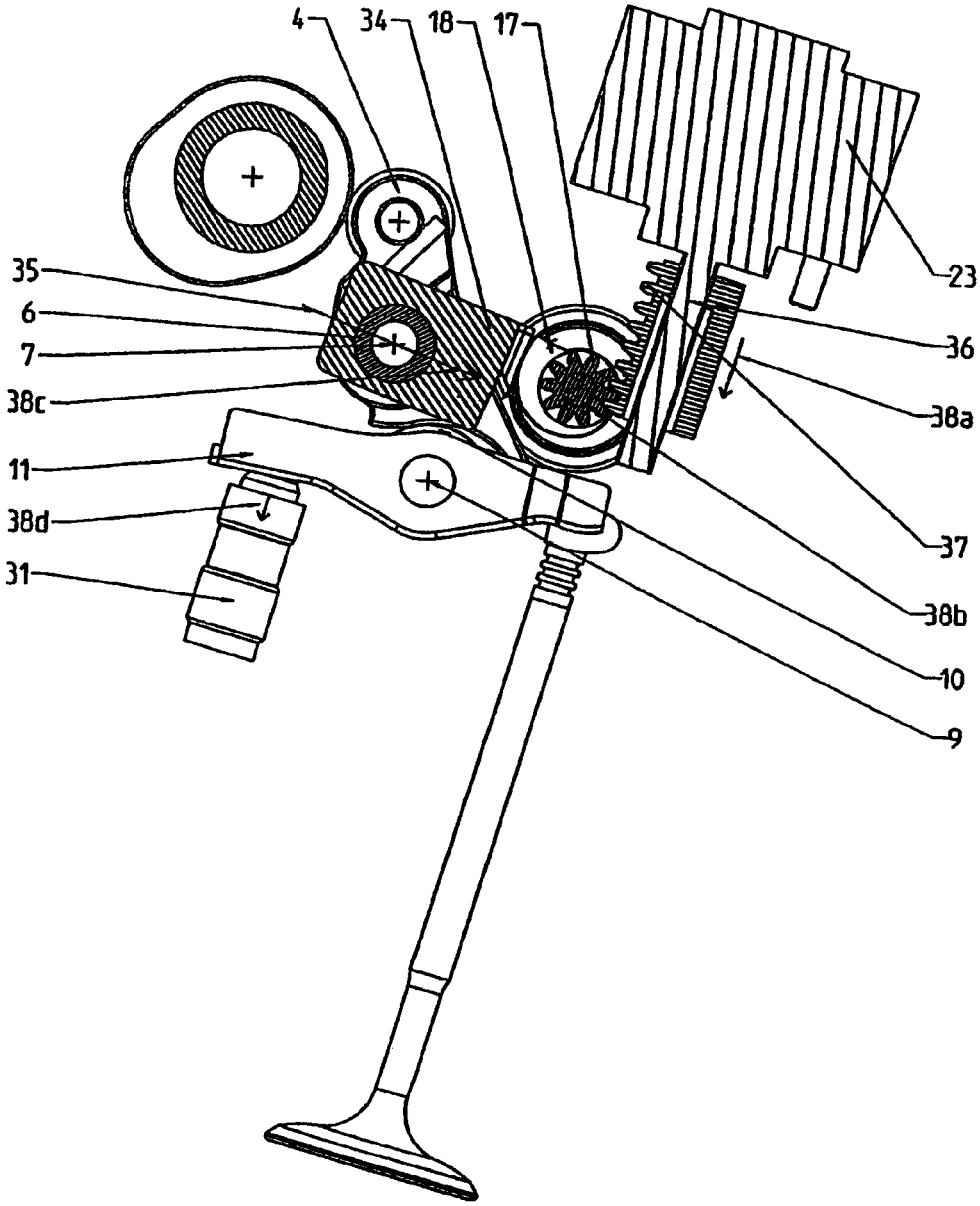
FIG. 6 is a cross-section through the device with a slide, adjusting shaft, and adjusting motor.

FIG. 6 shows a cross-section through an embodiment of the invention using a slide 34, which can be used separately for each valve or each pair of valves. The separate use results in the longest possible rest phases or common rest phases, so that it is easy for the adjustment to be done only during the rest phases. Controlling the individual cylinders using the inventive device even requires the separate arrangement. In this embodiment, bolt 6 is guided in a form-fit manner in the housing by slide 34, so that its axis 7 is guided along adjustment curve 35, a line. This line is only more or less approximately an arc about the axis 9 of roller 10 of the resting driven element 11. The deviation is exaggerated in FIG. 6. Now if the threaded spindle 36 driven by adjusting motor 23 rotates and displaces toothed rack 37 by the amount shown by arrow 38*a*, then adjusting shaft 17 and cam disks 18 rotate according to arrow 38*b* and slide 34 along with bolt 6 rotates in direction 38*c*. Because of the deviation of line 35 from the shape of an arc, play compensation element 31 must be lowered by a certain amount, which is shown by arrow 38*d*.

Figure 7:
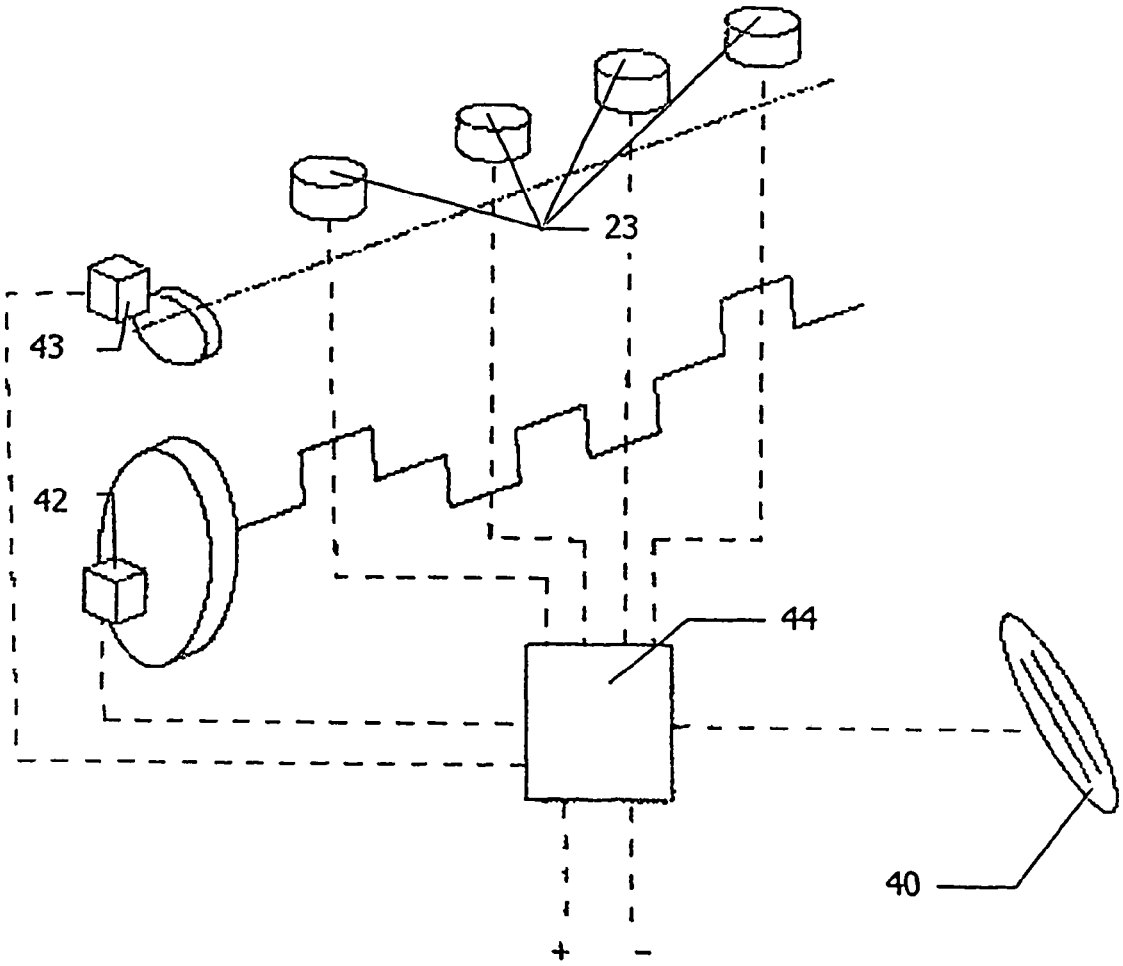
FIG. 7 is a diagrammatic representation of the interaction of the engine management system, the gas pedal, the rotational angle sensor, adjusting motors, and battery.

FIG. 7 is a diagrammatic illustration of the interaction of gas pedal 40, adjusting motors 23, rotational angle sensor 42 on the flywheel, and rotational angle sensor 43 on the camshaft with the engine management system 44. A signal coming from gas pedal 40, that is from a sensor for its position, is converted by engine management system 44 into a signal to adjusting motors 23 to increase or reduce the valve strokes. After the desired load state is achieved for the entire engine, the engine management system 44 evaluates the signals from the high-resolution rotational angle sensor 42 on the flywheel. They are assigned to the individual cylinders with the help of the low-resolution rotational angle sensors 43 on the camshaft or on another shaft running at half the crankshaft speed. This information is used to send signals to the individual adjusting motors 23 to even out the torque peak or the crankshaft speed, by correcting the valve strokes of the cylinders with smaller torques upward and correcting those of the cylinders with larger torques downward. In the inventive process an adjustment takes place, with or without compensation, during the common rest phases of the valves operated by an adjusting motor. The engine management system 44 takes their phase positions at the same time from sensor 43 of the camshaft.

LIST OF REFERENCE NUMBERS

1 Camshaft
2 Cam
3 Roller
4 Connecting link
5 Radial cam
5*a* Rest area
5*b* Lift area
6 Bolt
7 Axis
8 Adjustment curve
9 Axis
10 Roller
11 Driven element
12 Joint
13 Valve
14 Arrow
14*a* Direction arrow
15 Pendulum support

16 Joint
17 Adjusting shaft
18 Cam disk
18*a* Tappet
19 Intake valve
20 Exhaust valve
21 Sliding block
22 Articulated shaft
23 Adjusting motor
24 Four-bar linkage
25 Four-bar linkage
26 Four-bar linkage
27 Four-bar linkage
28 Adjustment curve
29 System line
30 System line
31 Play compensation element
32 Bearing block
33 Cover
34 Slide
35 Adjustment curve
36 Threaded spindle
37 Toothed rack
38*a* Arrow
38*b* Arrow
38*c* Direction
38*d* Arrow
40 Gas pedal
42 Rotational angle sensor
43 Rotational angle sensor
44 Engine management system

The invention claimed is:

1. An arrangement for variable actuation of gas exchange valves of internal combustion engines comprising: at least one cam on a camshaft mounted in said housing and rotating dependent on engine speed; an intermediate link driven by said cam; a bolt having an axis and mounting said intermediate link, said intermediate link carrying out an oscillating purely rotational motion about said axis, said bolt being displaceable parallel to itself along an adjustment curve; a control curve on said intermediate link and having a rest region as well as a lift region; a driving element actuated by said control curve for actuating in turn at least one of said valves; a four-bar linkage connected with an engine cylinder head for guiding said bolt and having first joints and second joints, said first joints comprising two joints fixed and spaced from each other in a first spacing, said second joints comprising two second joints each pivotable about one of said first joints, said two second joints having a spacing between them smaller than the spacing between said two first joints for guiding said bolt on a substantially arc-shaped adjustment curve.

2. An arrangement as defined in claim 1, including pendulum supports for connecting said bolt to said housing.

3. An arrangement as defined in claim 1, wherein said four-bar linkage connects said bolt with said housing.

4. An arrangement as defined in claim 1, including a slide connecting said bolt with said housing and guided on a straight line in said housing in a positive-fit manner.

5. An arrangement as defined in claim 1, wherein said driving element has a hydraulic play compensating element.

6. An arrangement as defined in claim 1, including at least one cam disk for adjusting a position of said bolt on said adjustment curve, said bolt being supported along said adjustment curve in a substantially tangential direction with respect to said housing.

7. An arrangement as defined in claim 1, including a hydraulic unit for specifying positions of said bolt on said adjustment curve and supports said bolt along said adjustment curve in tangential direction against said housing.

8. An arrangement as defined in claim 6, including an adjusting shaft for mounting said cam disk; and a motor for adjusting said adjusting shaft.

9. An arrangement as defined in claim 4, including an adjusting motor and a threaded spindle for bringing said slide into a desired position.

10. An arrangement as defined in claim 1, including a plurality of devices, one of said devices being separately assigned to each of said valves.

11. An arrangement as defined in claim 1, including a device assigned to each two adjacent parallel valves of an engine cylinder.

12. An arrangement as defined in claim 11, including a common intermediate link with two different radial cams for said two valves.

13. An arrangement as defined in claim 11, including two different links with different radial cams for said two valves.

14. An arrangement as defined in claim 1, including transmission elements forming at least one adjustment position for said intermediate link, at least one of said valves remaining closed during rotation of said cams.

15. An arrangement as defined in claim 1, wherein valves of a plurality of engine cylinders are commonly actuated in combination, said bolt being common and continuous for all intermediate links of said valves.

16. An arrangement as defined in claim 1, including at least one cam disk carried on said bolt, said bolt being freely rotatable and said disk being connected in a torsionally rigid manner; an adjusting motor for rotating said bolt, said cam disk being supported with respect to said housing.

17. An arrangement as defined in claim 16, including sliding blocks for supporting said cam disk and being of hard material in said housing.

18. An arrangement as defined in claim 1, including a common adjusting shaft having at least one cam disk with a section remaining in position when said adjusting shaft is twisted.

19. An arrangement as defined in claim 1, including a common adjusting shaft having at least one cam with a section remaining in position when said adjusting shaft is displaced.

20. An arrangement as defined in claim 1, including a crankshaft and a plurality of engine cylinders; a first rotational angle sensor on a flywheel for detecting rotational irregularities on the crankshaft; a second rotational angle sensor on said camshaft rotating at half the crank shaft speed; means for producing signals transmitted to individual drives to even out torque peaks and crankshaft speed by correcting valve strokes of said cylinders with smaller torques upward and larger torques downward.

21. An arrangement as defined in claim 1, including a plurality of engine cylinders with separate means for each cylinder and a drive for actuating said separate means, adjustment movements of said separate means being carried out during common rest phases of the valves operated by respective drives.

22. An arrangement as defined in claim 21, including a rotational angle sensor on said camshaft; and an engine management system for determining phase positions of the rest phases of individual valves from signals of said rotational angle sensor.

* * * * *